United States Patent [19]

Medina et al.

[11] 4,133,443

[45] Jan. 9, 1979

[54] SOAP DISH

[76] Inventors: Joseph Medina; Helene H. Medina, both of 914 Le Borgne, La Puente, Calif. 91746

[21] Appl. No.: 812,152

[22] Filed: Jul. 1, 1977

[51] Int. Cl.[2] ..... B65D 25/24; A47K 1/08; A47K 5/08

[52] U.S. Cl. ..... 220/18; 206/77.1; 248/285; 248/311.1 R; D6/89

[58] Field of Search ..... 220/18, 1 H, 85 H; D27/14; D6/89, 90; 206/77.1; 248/285, 311.1

[56] References Cited

U.S. PATENT DOCUMENTS

| | | | |
|---|---|---|---|
| D. 73,734 | 11/1927 | Baker | D6/89 |
| 2,147,861 | 2/1939 | Shopen | 248/311.1 X |
| 2,504,536 | 4/1950 | Kisselburg | 206/77.1 |
| 2,681,200 | 6/1954 | Bisson | 248/285 |
| 2,915,944 | 12/1959 | Butts | 248/285 X |
| 2,950,836 | 8/1960 | Murdock | 220/1 H |

*Primary Examiner*—William Price
*Assistant Examiner*—Steven M. Pollard
*Attorney, Agent, or Firm*—Jack C. Munro

[57] ABSTRACT

A soap dish which includes an extendible arm connected to a tray. The tray is pivotable with respect to the arm from a substantially horizontal position to a substantially inclined position in order to facilitate draining. The drain includes a restraining means to prevent disassociation of the cake of soap from the tray when the tray is in the draining position. A rod which extends from the lower surface of the tray cooperates within a mating aperture which permits pivoting of the tray with respect to the arm. Located about the rod and about the aperture are planar surfaces which are to be in abutting contact with one another.

8 Claims, 5 Drawing Figures

SOAP DISH

BACKGROUND OF THE INVENTION

The field of this invention relates to a soap dish which is to be particularly adapted to not only support a cake of soap but also to facilitate draining off water from the soap dish when not in use.

It is common knowledge that the water on a wet cake of soap, when the latter is returned to the soap dish, tends to drain off and collect in the bottom of the soap dish. The drain water carries along with it a certain amount of soap dissolved off the surface of the cake of soap. Thereafter, some of the water evaporates, and within a short time the bottom of the soap dish has an accumulation of a gelatinous mixture of partly dissolved soap.

Also, the bottom of the soap cake adjacent the soap dish tends to retain some of the water which causes the bottom of the cake of soap to become soft and slimy. As a result, the soap cake is not at all easy to repick up and regrasp and additionally is unpleasant to feel.

SUMMARY OF THE INVENTION

The structure of this invention is believed to be summarily in the Abstract Of The Disclosure and reference is to be had thereto. It is the primary objective of this invention to provide a combination soap dish and drainer which will overcome the aforementioned disadvantages of currently available soap dishes.

It is a further objective of this invention to construct the soap dish of this invention of few parts thereby facilitating inexpensive manufacture.

The soap dish of the present invention is distinctly characterized in that the cake of soap is in an angularly disposed position during the draining operation so that all of the water will drain off the bottom of the soap cake and leave it dry so that no slimy surface remains when the soap tray is thereafter moved to its horizontal rest position.

DETAILED DESCRIPTION OF THE SHOWN EMBODIMENT

Figure 1:
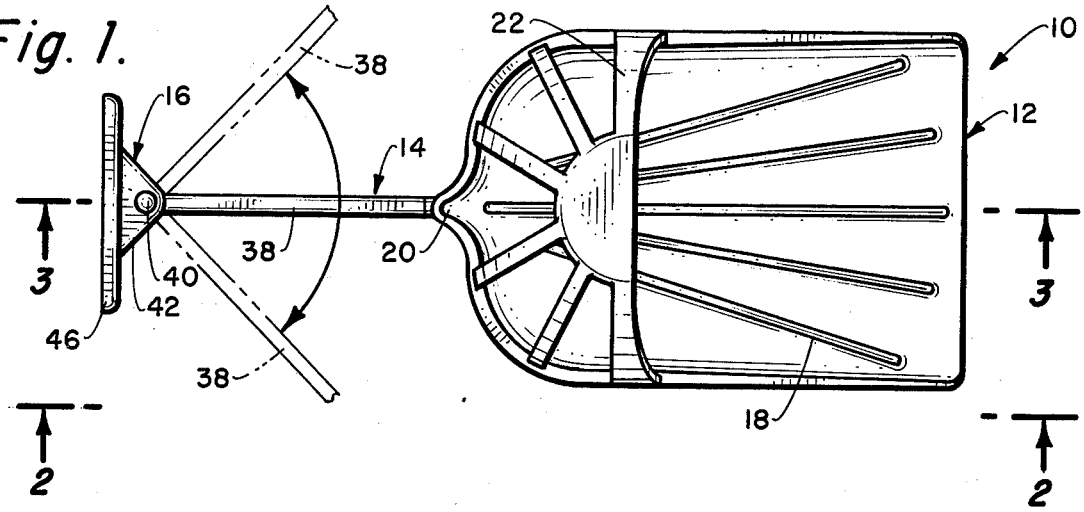
FIG. 1 is a plan view of the soap dish of this invention.

Referring in particular to the drawing, there is shown in FIG. 1 the soap dish 10 of this invention which is generally composed of a soap cake supporting tray 12, an arm assembly 14 and a bracket 16. The tray 12 includes an upper soap cake supporting surface which includes a plurality of ridges 18. It is to be noted that the upper surface of the tray 12 is slightly inclined in a downward direction towards the front end of the tray 12. The front end of the tray 12 is characterized by including a small spout 20. The inclining of the tray 12 is so that moisture upon the cake of soap (not shown) located upon the upper surface of the tray 12 will be conducted toward the spout 20. Also, the cake of soap will be naturally inclined to move along the ridges 18 toward the front end of the tray 12. Therefore, the inclining of the supportive surface of the tray 12 is naturally to tend to prevent accidental dislodgement of the soap cake from the tray 12.

Figure 5:
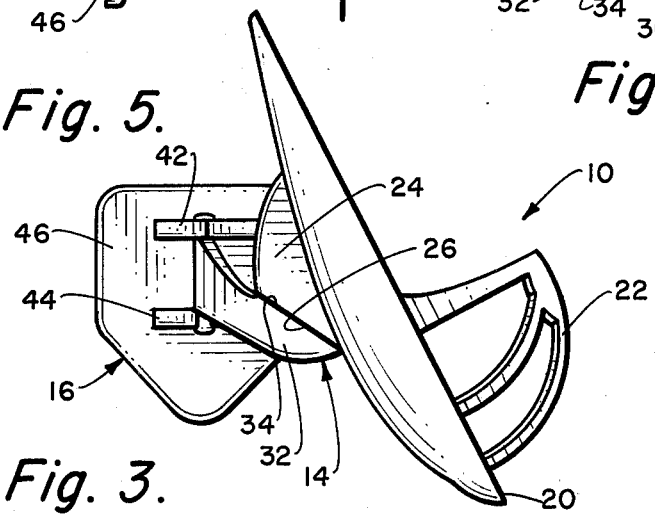
FIG. 5 is an end view of the soap dish of this invention showing the tray for supporting the soap in an inclined position.
Figure 4:
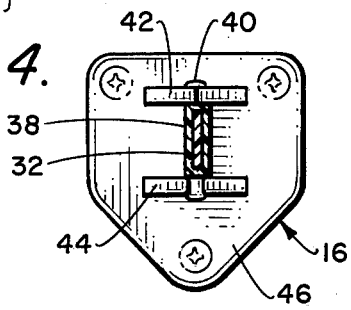
FIG. 4 is a partly in cross-section view taken along line 4—4 of FIG. 2.
Figure 3:
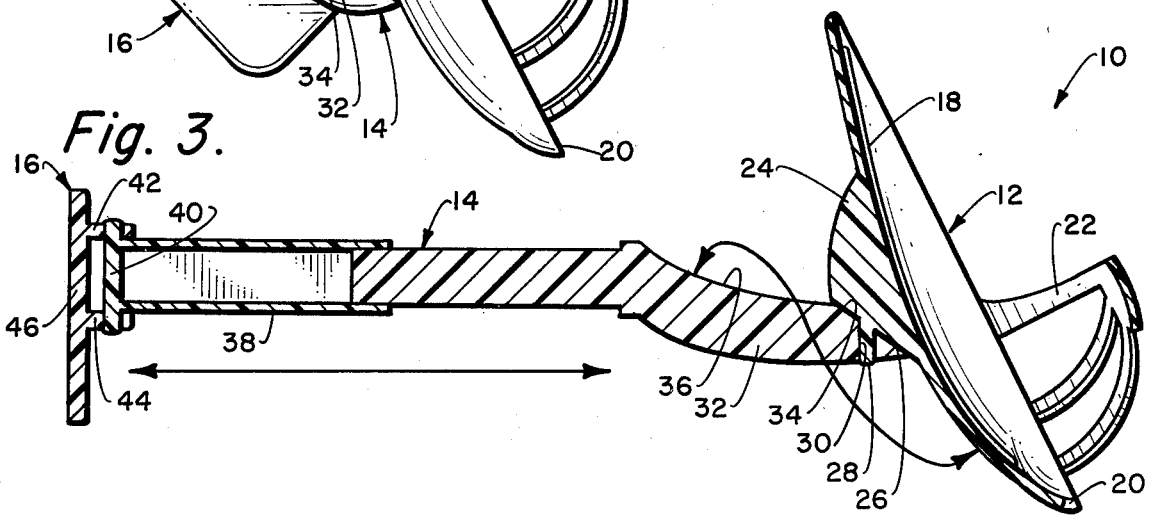
FIG. 3 is a cross-sectional view up through the soap dish of this invention taken along line 3—3 of FIG. 1.

Located about the front end of the tray 12 is a restraining means in the form of a lattice basket section 22. With the tray 12 in the inclined position shown in FIGS. 3 and 5 of the drawing, the soap cake will be maintained in contact with the tray 12 by means of the basket section 22.

Integrally attached to the lower surface of the tray 12 is a member 24. The member 24 includes a first planar surface 26. A rod 28 extends substantially centrally from the surface 26.

Figure 2:
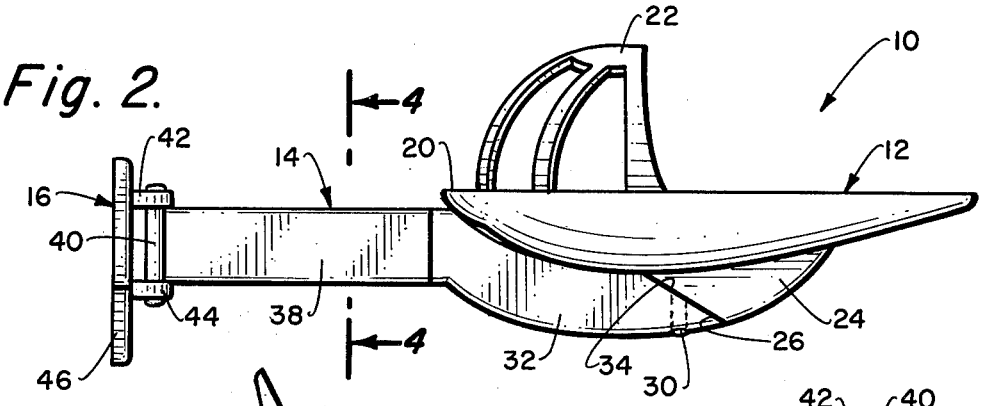
FIG. 2 is a side view of the soap dish of this invention taken along line 2—2 of FIG. 1.

The rod 28 is to matingly locate within an aperture 20 which is formed within the forward end of the arm 32 of the arm assembly 14. A second planar surface 34 is located about the aperture 30 and is to be in abutting contact with the first planar surface 26. It is to be understood that the tray 12 is to be pivotable between a first position or substantially horizontal position shown in FIG. 2, or to a second position which is an inclined position shown in FIGS. 3 and 5. With the tray 12 in the first position, the tray closely conforms to the curved upper surface 36 of the arm 32. With the tray 12 in the position shown in FIGS. 3 and 5, substantially all of the moisture collected upon the surface of the tray 12 will be conducted past the ridges 18 and expelled through the spout 20. It is to be understood that the soap dish 10 of this invention will normally be mounted within a bathing enclosure such as a shower or bath tub or over a lavatory.

The inner end of the arm 32 is telescopingly mounted within a second arm 38. The pin 40 is pivotly mounted within aligned openings of spaced apart members 42 and 44. The members 42 and 44 are integrally formed upon a plate 46 of the bracket 16. The plate 46 is to cooperate with a conventional type of fastening means to secure such to a vertical wall.

It can be readily seen that the arm assembly 14 is swingable or pivotable to different positions in respect to the bracket 16. This swinging movement is depicted generally by phantom lines within FIG. 1.

In the operation of the device of this invention, the tray 12 can be moved to any desired position due to the swinging or pivoting of the arm assembly 14 in respect to bracket 16. Additionally, a soap cake located upon the tray 12 is to be used in the conventional manner and after use has terminated, the soap cake is placed upon the tray 12. Prior to the person no longer requiring the use of the device, the person merely grasps the tray 12 and effects pivoting of such to second or inclined position. Normally, this inclined position will be maintained for a period of several hours until the upper surface of the tray 12, as well as the soap cake becomes dry. At that particular time, the tray 12 can be repositioned to the horizontal position shown in FIGS. 1 and 2. It is to be noted that the tray 12 is pivotable through three hundred and sixty degrees.

What is claimed is:

1. A soap dish comprising:

an arm having an inner end and an outer end. said arm having a longitudinal center axis adapted to be located horizontal, said inner end including first connecting means, said outer end including second connecting means;

a tray adapted to receive a cake of soap, said tray having a front end and a back end, said tray having third connecting means, said second connecting means including a first planer surface inclined with respect to said longitudinal center axis, said third connecting means including a second planer surface inclined with respect to said longitudinal center axis, said first and second planer surfaces to always be in continuous contact with each other, said second and third connecting means cooperating to support said tray upon said arm, said tray being movable upon said arm from a first position to a second position, said first position being with said tray located substantially horizontal, and in longitudinal alignment with said longitudinal center axis and with said front end extending forwardly of said arm and said back end located directly above said arm, said second position being with said tray located at an inclined position, with said front end now located above said arm and said back end now directed forwardly of and below said arms, said third connecting means being fixedly positioned upon said tray.

2. The soap dish as defined in claim 1 wherein:
said second and third connecting means including a rod pivotly mounted within a mating aperture.

3. The soap dish as defined in claim 1 wherein:
said arm including extending means so as to vary the distance between said bracket and said tray.

4. The soap dish as defined in claim 1 wherein:
said third connecting means being integral with said tray.

5. The soap dish as defined in claim 1 wherein:
the upper surface of said tray including restraining means, whereby with said tray in said second position said restraining means will prevent removal of a cake of soap from said tray.

6. The soap dish as defined in claim 5 wherein:
with said tray in said first position the upper surface of said tray being slightly inclined toward said restraining means, whereby a cake of soap naturally tends to maintain the cake of soap in position upon the tray by having the cake of soap slidingly move along the inclined surface of the tray toward said restraining means.

7. The soap dish as defined in claim 1 wherein:
a bracket, said first connecting means connecting said arm to said bracket, said arm being privotly mounted with respect to said bracket.

8. A soap dish as defined in claim 1 wherein:
said second and said third connecting means including a rod pivotly mounted within a mating aperature, said arm including extending means so as to vary the distance between said bracket and said tray, the upper surface of said tray including restraining means, whereby with said tray in said second position said restraining means will prevent removal of a cake of soap from said tray, with said tray in said first position the upper surface of said tray being slightly inclined towards said restraining means, whereby a cake of soap naturally tends to be maintained in position upon the tray by having the cake of soap slidingly move along the inclined surface of said tray toward said restraining means.

* * * * *